US008836313B2

(12) United States Patent
Takagi et al.

(10) Patent No.: US 8,836,313 B2
(45) Date of Patent: Sep. 16, 2014

(54) CONSTANT CURRENT SOURCE AND SOLID IMAGING APPARATUS USING THE SAME

(75) Inventors: Makoto Takagi, Kawasaki (JP); Kazuo Yamazaki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 13/188,519

(22) Filed: Jul. 22, 2011

(65) Prior Publication Data

US 2012/0038343 A1 Feb. 16, 2012

(30) Foreign Application Priority Data

Aug. 10, 2010 (JP) ..... 2010-179744

(51) Int. Cl.
*G05F 3/08* (2006.01)
*G05F 3/26* (2006.01)

(52) U.S. Cl.
USPC ..... 323/314; 323/316

(58) Field of Classification Search
USPC ..... 323/312–315, 299; 327/538–543
See application file for complete search history.

(56) References Cited

U.S. PATENT DOCUMENTS

| | | | | |
|---|---|---|---|---|
| 6,445,170 | B1 * | 9/2002 | Pangal et al. | 323/315 |
| 7,218,166 | B2 | 5/2007 | Yanagisawa et al. | 327/538 |
| 7,423,790 | B2 | 9/2008 | Kochi et al. | |
| 7,521,971 | B2 | 4/2009 | Yamazaki | 327/112 |
| 7,586,432 | B2 | 9/2009 | Maruyama | 341/169 |
| 7,701,185 | B2 * | 4/2010 | Matsuda | 323/277 |
| 7,816,755 | B2 | 10/2010 | Yamazaki et al. | |
| 7,893,671 | B2 * | 2/2011 | Sahni et al. | 323/280 |
| 8,049,799 | B2 | 11/2011 | Sonoda et al. | |
| 8,102,200 | B2 * | 1/2012 | Araki | 327/538 |
| 2007/0024290 | A1 | 2/2007 | Endoh | 324/705 |
| 2011/0298443 | A1 * | 12/2011 | Kanemitsu | 323/299 |

FOREIGN PATENT DOCUMENTS

| | | | |
|---|---|---|---|
| CN | 1716143 | A | 1/2006 |
| CN | 101232286 | A | 7/2008 |
| CN | 101777904 | A | 7/2010 |
| JP | 2001-211380 | A | 8/2001 |
| JP | 2006-018663 | A | 1/2006 |
| JP | 2007-129473 | A | 5/2007 |

OTHER PUBLICATIONS

Office Action issued by the Chinese Patent Office on Dec. 2, 2013, in counterpart Chinese Appl'n. No. 2011-10226144.5.

* cited by examiner

*Primary Examiner* — Jessica Han
(74) *Attorney, Agent, or Firm* — Fitzpatrick, Cella, Harper & Scinto

(57) ABSTRACT

A constant current source has a first current source circuit for outputting a first current; a second current source circuit for outputting a second current according to a reference voltage; a current comparison circuit for comparing magnitudes of the first and second currents; and a current adjustment unit for adjusting a current value of the first current output from the first current source circuit in accordance with a comparison result of the current comparison circuit.

14 Claims, 4 Drawing Sheets

CONSTANT CURRENT SOURCE AND SOLID IMAGING APPARATUS USING THE SAME

BACKGROUND OF THE INVENTION

1. Field of the Invention

The present invention relates to a constant current source and a solid imaging apparatus using the same.

2. Description of the Related Art

In recent years, as a solid imaging apparatus, a CMOS type solid imaging apparatus (hereafter, referred to as a CMOS sensor) has widely been used. According to the CMOS sensor, photocharges generated in a photoelectric conversion unit are transferred to a floating diffusion one row by one and signals are simultaneously read out of vertical read-out lines to a signal processing unit on a row unit basis by using a source-follower of each column. A constant current source of each column for driving each source-follower is generally biased by a common current source circuit. If current noise components having a correlation exist in an output current of each constant current source, output signal noises common to each column are generated and are recognized as horizontal stripe noises in an image. Therefore, it is necessary that the constant current source which is used in the CMOS sensor is a low-noise circuit, and it is necessary to reduce the noises which are generated in the common current source circuit.

The Japanese Patent Application Laid-Open Gazette No. 2007-129473 discloses such a technique that in order to reduce an electric potential fluctuation of a vertical read-out line which is caused by exogenous noises, a resistor (7 in FIG. 1) is connected to a common gate line (5 in FIG. 1) of MOS transistors of the constant current source. According to such a technique, the noises which are generated in the common current source circuit (4 in FIG. 1) are also simultaneously reduced.

A current value of the common current source circuit disclosed in the Japanese Patent Application Laid-Open Gazette No. 2007-129473 fluctuates in accordance with a resistance value, a variation in characteristics of the transistors, and a power source voltage to be used. Generally, in the CMOS sensor manufactured by a semiconductor process, there is a variation of tens of % with respect to the resistance value and there is a variation in a range from tens of mV to about 100 mV with respect to a threshold value of the transistor. In the use of CMOS sensor, since there is also a case where a different power source voltage is set for every product, a variation in current value of the constant current source is large. As the current of the constant current source increases, an increase in current consumption is caused. On the contrary, as the current decreases, a driving power of the source-follower is reduced and a read-out speed of the pixel is decreased.

SUMMARY OF THE INVENTION

According to an aspect of the invention, there is provided a constant current source comprising: a first current source circuit for outputting a first current; a second current source circuit for outputting a second current according to a reference voltage; a current comparison circuit for comparing magnitudes of the first current and the second current; and a current adjustment unit for adjusting a current value of the first current output from the first current source circuit in accordance with a result of the comparison of the current comparison circuit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
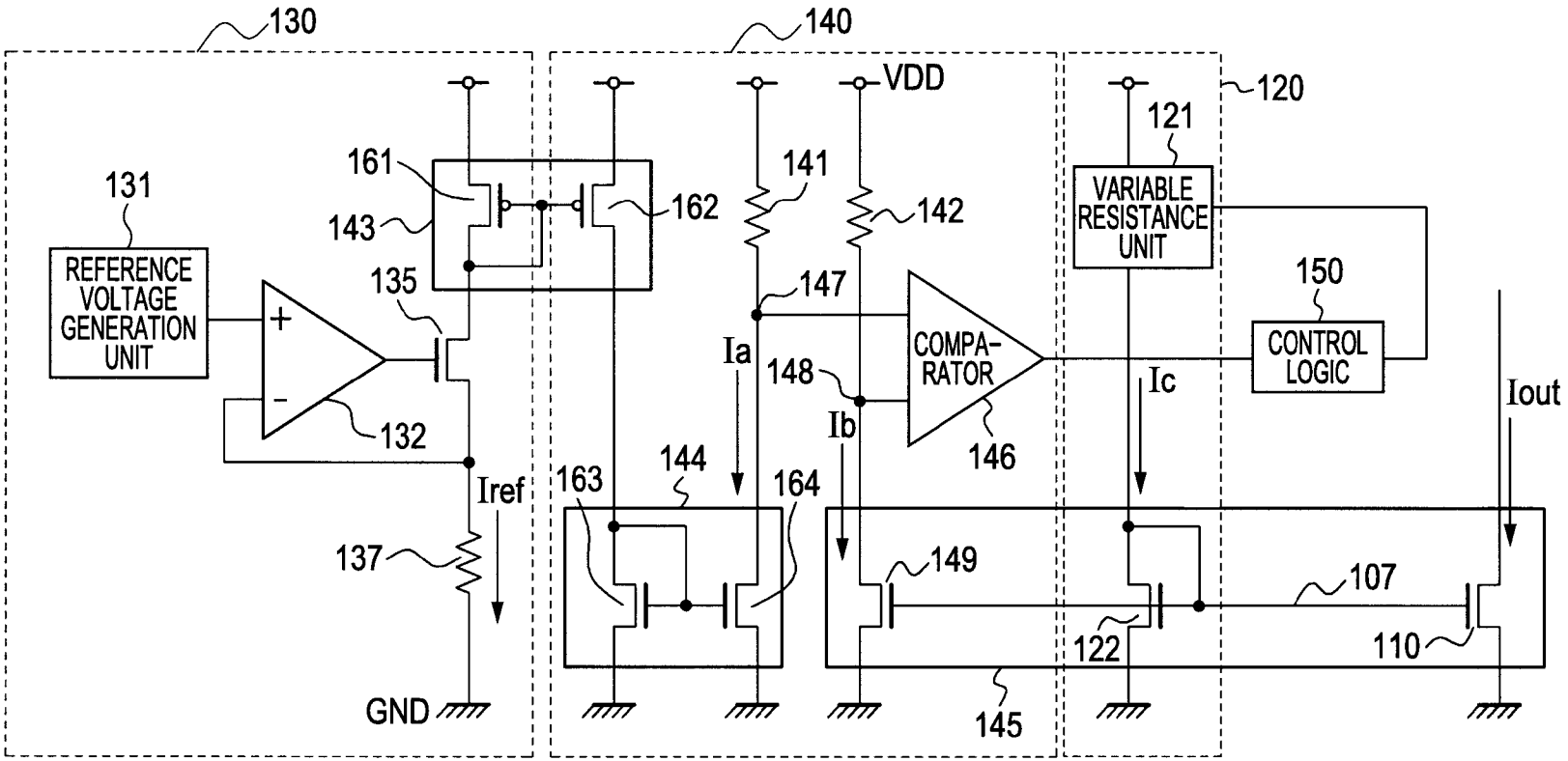
FIG. 1 is a diagram illustrating an exemplary arrangement of a constant current source according to the first embodiment of the invention.

FIG. 1 is a diagram illustrating an exemplary arrangement of a constant current source according to the first embodiment of the invention. The constant current source has: NMOS transistors 110 (only one transistor is illustrated in FIG. 1) of the constant current source having a plurality of outputs; a first current source circuit 120; a second current source circuit 130; a current comparison circuit 140; and a control logic circuit 150. The control logic circuit 150 is a current adjustment unit for adjusting a current value of the first current source circuit 120. The first current source circuit 120 has: a variable resistance unit 121; and an NMOS transistor 122 of a current mirror circuit 145. The second current source circuit 130 has: a reference voltage generating unit 131; an operational amplifier 132; an NMOS transistor 135; a resistor 137; and a PMOS transistor 161 of a current mirror circuit 143. The current comparison circuit 140 has: resistors 141 and 142; a current mirror circuit 144; an NMOS transistor 149 of the current mirror circuit 145; and a comparator 146. In the current mirror circuit 145, a gate of the NMOS transistor 122 of the first current source circuit 120, a gate of the NMOS transistor 149 of the current comparison circuit 140, and a gate of the NMOS transistor 110 of the constant current source are connected to a voltage supplying line 107. The current mirror circuit 143 has PMOS transistors 161 and 162. The current mirror circuit 144 has NMOS transistors 163 and 164.

First, the arrangement of the first current source circuit 120 will be described. The variable resistance unit 121 is connected between a node of a power source voltage VDD and a drain of the NMOS transistor 122. The NMOS transistor 122 has a drain connected to the gate, the gate connected to the voltage supplying line 107, and a source connected to a ground electric potential node. That is, the NMOS transistor 122 is diode-connected and is connected in series to the variable resistance unit 121.

Next, an arrangement of the second current source circuit 130 will be described. The PMOS transistor 161 has a source connected to the node of the power source voltage VDD, a gate connected to a drain, and the drain connected to a drain of the NMOS transistor 135. The resistor 137 is connected between a source of the NMOS transistor 135 and the ground electric potential node. The reference voltage generating unit 131 outputs a predetermined voltage Vb. The operational amplifier 132 has a non-inversion input terminal connected to an output terminal of the reference voltage generating unit 131, an inversion input terminal connected to the source of the NMOS transistor 135, and an output terminal connected to a gate of the NMOS transistor 135.

Subsequently, an arrangement of the current comparison circuit 140 will be described. The PMOS transistor 162 has a source connected to the node of the power source voltage VDD, a gate connected to the gate of the PMOS transistor 161, and a drain connected to a drain of the NMOS transistor 163. The NMOS transistor 163 has a drain connected to a gate and a source connected to the ground electric potential node. The resistor 141 is connected between the node of the power source voltage VDD and a node 147. The NMOS transistor 164 has a drain connected to the node 147, a gate connected to the gate of the NMOS transistor 163, and a source connected to the ground electric potential node. The resistor 142 is connected between the node of the power source voltage VDD and a node 148. The NMOS transistor 149 has a drain connected to the node 148, a gate connected to the voltage supplying line 107, and a source connected to the ground electric potential node. The comparator 146 compares voltages at the nodes 147 and 148.

The control logic circuit 150 controls a resistance value of the variable resistance unit 121 on the basis of an output signal of the comparator 146. The NMOS transistor 110 has a gate connected to the voltage supplying line 107 and a source connected to the ground electric potential node.

In the following description, a current flowing in the resistor 137 is referred to as Iref, a current flowing in the resistor 141 is referred to as Ia, a current flowing in the resistor 142 is referred to as Ib, a current flowing in the NMOS transistor 122 is referred to as Ic, and a current flowing in the NMOS transistor 110 of the constant current source is referred to as Iout.

In the second current source circuit 130, the voltage Vb that is almost constant irrespective of a variation on manufacturing and a change in ambient environment is supplied from the reference voltage generating unit 131 to the non-inversion input terminal of the operational amplifier 132. By the voltage feedback to the inversion input terminal of the operational amplifier 132, a voltage at the source terminal of the NMOS transistor 135 is also equal to Vb. The current Iref is determined by the voltage Vb and a resistance value of the resistor 137. The second current source circuit 130 outputs a second current Iref according to the reference voltage Vb. The current Iref is copied by a gain set by the current mirror circuits 143 and 144 and the current Ia is determined. For example, the reference voltage generating unit 131 can be configured using a band gap circuit. By selecting a resistor having a higher precision and a smaller temperature change characteristic as a resistor 137, a resistance value becomes almost constant irrespective of the environment and a variation. Since the current Iref is determined by the voltage Vb generated by the reference voltage generating unit 131 and the resistance value of the resistor 137, its precision is high.

However, if the reference voltage generating unit 131 is configured using the band gap circuit, since the number of elements of the circuit is large, noises of the voltage Vb are large. In addition to the noises of the voltage Vb, since noises which are generated in the operational amplifier 132, NMOS transistor 135, and resistor 137 are added to the current Iref by a square root of a sum of squares, those noises further increase. A precision of a current value of the current Ia flowing in the resistor 141 that is obtained by copying the current Iref by the gain set by the current mirror circuits 143 and 144 is high as well as the current Iref. With respect to the noises, since noises that are generated in the transistors of the current mirror circuits 143 and 144 are added, they further increase. As mentioned above, in the second current source circuit 130, even if the noises are large, since the noises are much smaller than the current, no problem will occur. The precision of the current value is important.

In the first current source circuit 120, the value of the current Ic is determined by the resistance value of the variable resistance unit 121, the voltage between the gate and the source of the NMOS transistor 122, and the power source voltage VDD. The first current source circuit 120 outputs the first current Ic. The variable resistance unit 121 adjusts the current Ic by changing the resistance value by control of the control logic circuit 150. In the embodiment, component elements other than the resistor 137 are formed on a same semiconductor substrate by a semiconductor process. Therefore, there are also a variation on manufacturing in the resistance value of the variable resistance unit 121 and the gate-source voltage of the NMOS transistor 122. Thus, the value of the current Ic also varies. On the other hand, the first current source circuit 120 has such a simple circuit arrangement that one variable resistance unit 121 and one NMOS transistor 122 are used, and the number of elements that may be a noise source is small. Therefore, the noises of the current Ic can be suppressed to a small amount. The current Ib flowing in the resistor 142 that is obtained by copying the current Ic by the gain set by the current mirror circuit 145 and the current Iout of the constant current source also have characteristics similar to those of the current Ic.

In the current comparison circuit 140, voltages at the nodes 147 and 148 obtained by converting the currents Ia and Ib into the voltages by the resistors 141 and 142 are compared by the comparator 146. The current comparison circuit 140 compares the magnitudes of the currents Ib and Ia, that is, the magnitudes of the first current Ic and the second current Iref. A comparison result is output to the control logic circuit 150. In accordance with the comparison result of the current comparison circuit 140, the control logic circuit 150 adjusts the resistance value of the variable resistance unit 121 of the first current source circuit 120 for an adjustment period of time so as to reduce a difference between the currents Ia and Ib. By adjusting the resistance value of the variable resistance unit 121, the current value of the first current Ic is adjusted. The value adjusted for the adjustment period of time is held for a period of time other than the adjustment period of time. The NMOS transistor 110 of the constant current source is biased by the first current source circuit 120 and outputs a current having smaller noises and a higher precision. Although an example in which the external resistor is used as a resistor 137 in the embodiment is described, an internal resistor formed on the same substrate may be used as long as its characteristics are acceptable.

Figure 2:
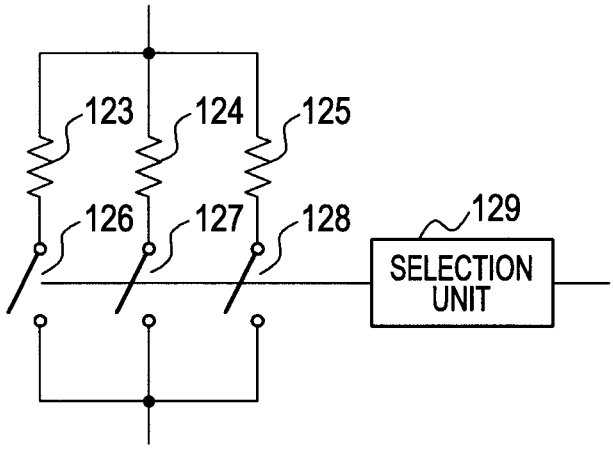
FIG. 2 is a diagram illustrating an example of an arrangement of a variable resistance unit of the first embodiment.

FIG. 2 is a diagram illustrating an example of an arrangement of the variable resistance unit 121 in FIG. 1. The operation of the variable resistance unit 121 based on a switch-over of the resistors will be described in detail with reference to FIG. 2. The variable resistance unit 121 in the embodiment has resistors 123, 124, and 125 having different resistance values, switches 126, 127, and 128, and a selection unit 129. The resistor 123 and the switch 126 connected in series, the resistor 124 and the switch 127 connected in series, and the resistor 125 and the switch 128 connected in series are connected in parallel. The selection unit 129 is connected to the control logic circuit 150 and switches a conduction/non-conduction of each of the switches 126, 127, and 128 in accordance with an output of the control logic circuit 150. The selection unit 129 is arranged by a selection circuit in which logic circuits are combined. The variable resistance unit 121 is not limited to the unit illustrated in FIG. 2 but also incorporates a unit that can continuously change the resistance value, for example, such a unit that a current amount is controlled by controlling a resistance value of a MOS transistor. Assume a condition where the power source voltage VDD is 3.3V, a target value of the current Ic after the current adjustment is 100 μA, and a variation amount of the resistance value of the resistor of the variable resistance unit 121 is ±10%. Also assume that a gate-source voltage Vgs of the NMOS transistor 122 is 0.7V and a variation of the voltage Vgs is ±0.1 V. Further assume that a relative precision of the resistance values of the resistors 123, 124, and 125 is sufficiently high. Assuming that the resistance value of the variable resistance unit 121 is equal to R, the current Ic is expressed by the following equation.

$$Ic=(3.3-Vgs)/R$$

That is, if there is no variation in the voltage Vgs, the resistance value R is 26 kΩ. If the resistance value is increased by 10% and the voltage Vgs is 0.8V, a design value of the resistance value R necessary to set the current Ic to 100 μA is 22.7 kΩ. If the resistance value is reduced by 10% and the voltage Vgs is 0.6V, a design value of the resistance value R necessary to set the current Ic to 100 μA is 30 kΩ. In order to absorb the variations of the resistance value and the voltage Vgs by the switching of the resistors and tune the current Ic to a value near 100 μA, the values of the three resistors are set as follows so as to minimize a possible error ratio of the resistance values.

Resistor 123: 22.7+(30−22.7)×5/6=28.8 kΩ

Resistor 124: 22.7+(30−22.7)×3/6=26.4 kΩ

Resistor 125: 22.7+(30−22.7)×1/6=23.9 kΩ

By setting the values of the resistors 123, 124, and 125 as mentioned above and selecting the resistor so that the current Ic is closest to 100 μA, a maximum error of the current Ic can be reduced to about 5% from about 14% in the case where no adjustment is made. Although the number of resistors of the variable resistance unit 121 is set to 3 in the embodiment, the current Ic can be further precisely adjusted by increasing the number of resistors. Instead of switching over the resistors, by short-circuiting a part of the serially-connected resistors by a switch or by connecting the resistors in parallel by a switch, the resistance value of the variable resistance unit 121 can be also adjusted. The arrangement of the variable resistance unit 121 is not limited to the use of the resistors and the switches. For example, such an arrangement is also possible that the variable resistance unit 121 is arranged with a MOS transistor, an output of the selection unit 129 is set to an analog voltage, the gate voltage is operated, and the current amount is adjusted. Further, as a method of adjusting the value of the current Ic, the adjustment can be made by setting the variable resistance unit to a fixed resistance value and not applying the power source voltage VDD to the resistance unit but applying a variable voltage.

Figure 3:
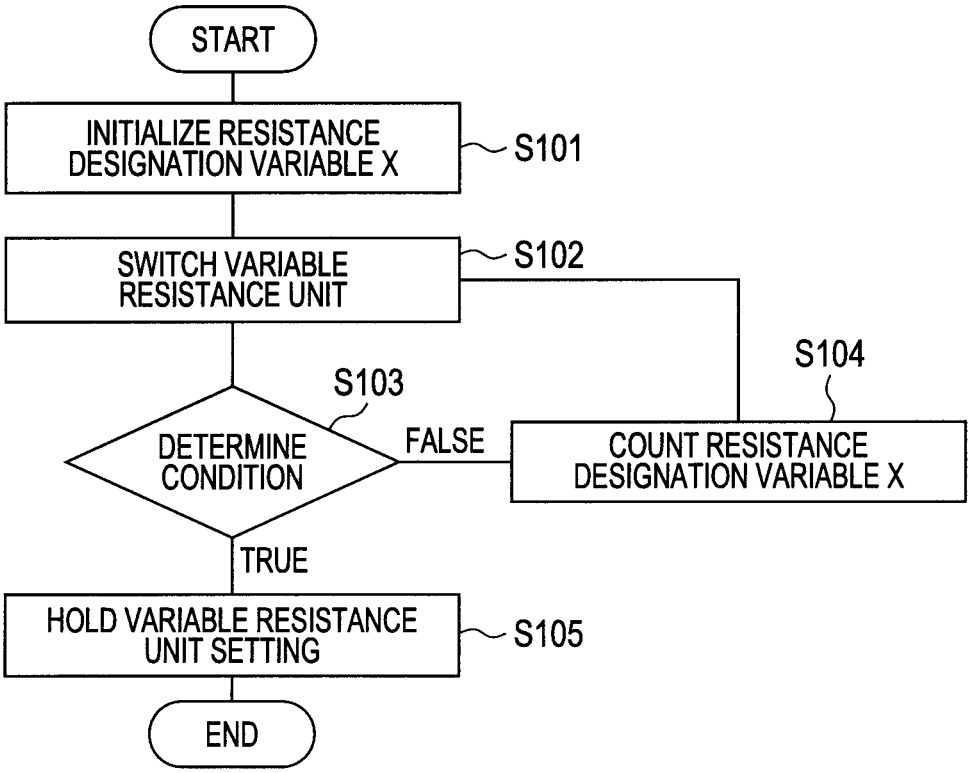
FIG. 3 is a flowchart illustrating processes of the constant current source according to the first embodiment.

FIG. 3 is a flowchart regarding a sequence for tuning the current value of the constant current source. In the embodiment, a case where the variable resistance unit 121 has n resistors for current adjustment will be described as an example.

In step S101, when the adjustment of the current Ic is started, the control logic circuit 150 initializes a value of a resistor designation variable "x" used to designate the resistor selected by the variable resistance unit 121 to 0.

Subsequently, in step S102, the selection unit 129 makes one of the switches in the variable resistance unit 121 conductive on the basis of an output of the control logic circuit 150. If the value of the resistor designation variable "x" is equal to 0, the resistor having the maximum resistance value is made conductive as an initial resistor. Thus, an initial value of the current Ic is set to the current according to the power source voltage VDD, the maximum resistance value, and the gate-source voltage Vgs of the NMOS transistor 122. The comparator 146 compares the voltages at the nodes 147 and 148 and outputs a comparison result showing their magnitude relation to the control logic circuit 150.

Subsequently, in step S103, the control logic circuit 150 verifies the output of the comparator 146 and the value of the resistor designation variable "x" to determine whether or not one of the following two conditions (1) and (2) is satisfied. A voltage V(147) denotes a voltage at the node 147 and a voltage V(148) denotes a voltage at the node 148.

$$V(148)<V(147) \quad (1)$$

$$x=n-1 \quad (2)$$

As mentioned above, the initial value of the variable resistance unit 121 is equal to the maximum resistance value. At this time, the current Ic is set to the minimum value and the voltage of the voltage supplying line 107 is also set to the lowest value. Thus, the current Ib is also set to the minimum value by the current mirror circuit 145 and the voltage V(148) at the node 148 is also set to the highest value. At the initial time, in many cases, the voltage V(148) at the node 148 is higher than the voltage V(147) at the node 147 and the above condition (1) is not satisfied. At the initial time, since the value of the resistor designation variable "x" is equal to 0, the above condition (2) is not satisfied either. If a determination result is "false" in step S103, the process transfers to step S104, and if it is "true", the process transfers to step S105. If none of the conditions (1) and (2) is satisfied, the processing routine proceeds to step S104.

In step S104, the control logic circuit 150 increases the value of the resistor designation variable "x" by one. In next step S102, the resistor having the resistance value of the variable resistance unit 121 smaller by one step is made conductive. Since the value of the variable resistance unit 121 decreases, the current Ic increases and the voltage of the voltage supplying line 107 also increases. Thus, the current Ib is also increased by the current mirror circuit 145. By a loop process of steps S102 to S104, the resistance value of the variable resistance unit 121 decreases gradually and the voltage V(148) at the node 148 decreases gradually. Then, the voltage V(148) at the node 148 becomes lower than the voltage V(147) at the node 147, the above condition (1) is satisfied. The processing routine proceeds to step S105. If the condition (2) is satisfied, since the resistance value of the variable resistance unit 121 cannot be reduced any more, the process transfers to step S105.

In step S105, the control logic circuit 150 holds the value of the resistor designation variable "x" and finishes the tuning sequence of the current Ic. That is, if the comparison result of the current comparison circuit 140 indicates that the above condition is satisfied, the control logic circuit 150 fixes the adjustment of the resistance value (current value of the first current Ic) of the variable resistance unit 121.

By executing the foregoing sequence, the current value Ic of the first current source circuit 120 can be made close to the current value Iref of the second current source circuit 130 that is difficult to be influenced by the variation on manufacturing. The arrangement in which the control logic circuit 150 holds the setting of the variable resistance unit 121 prevents the first current source circuit 120 from being influenced by the noises of the second current source circuit 130. Since the NMOS transistor 110 of the constant current source is biased by the first current source circuit 120, the precision of the current value of the current Iout is also high and its noises are small.

Although the resistors are switched from the resistor of the high resistance value to the resistor of the low resistance value in the embodiment, the invention is not limited to such an arrangement, as long as the current Ic can be adjusted to the current value near the set target. In this case, the flow regarding the tuning sequence of the current value and the operation of each step may differ. It is noted that the tuning sequence of the current value may be executed in accordance with the necessity on use, for example, it may be executed in response to the operation at the start of the operation of the solid imaging apparatus as in the case of the turn-on of the power source, may be executed at every predetermined time, or the like. It is also possible to change the current value of the set target in accordance with a change in operating mode of the solid imaging apparatus in which the constant current source is incorporated to perform the current value tuning sequence.

As described above, the constant current source is configured such that the current value of the first current source circuit 120 having the lower precision of the current value but the smaller noises is tuned to that of the second current source circuit 130 having the higher precision of the current value but the larger noises and the setting of the variable resistance unit 121 is held. Since the current Iout of the NMOS transistor 110 of the constant current source is obtained by copying the current Ic of the NMOS transistor 122 using the gain set by the current mirror circuit 145, also with respect to the current Iout, the precision of the current value is high and the noises are large. According to the foregoing arrangement, in the embodiment, the constant current source having the low noise characteristics and the high current value precision can be realized.

Second Embodiment

Figure 4:
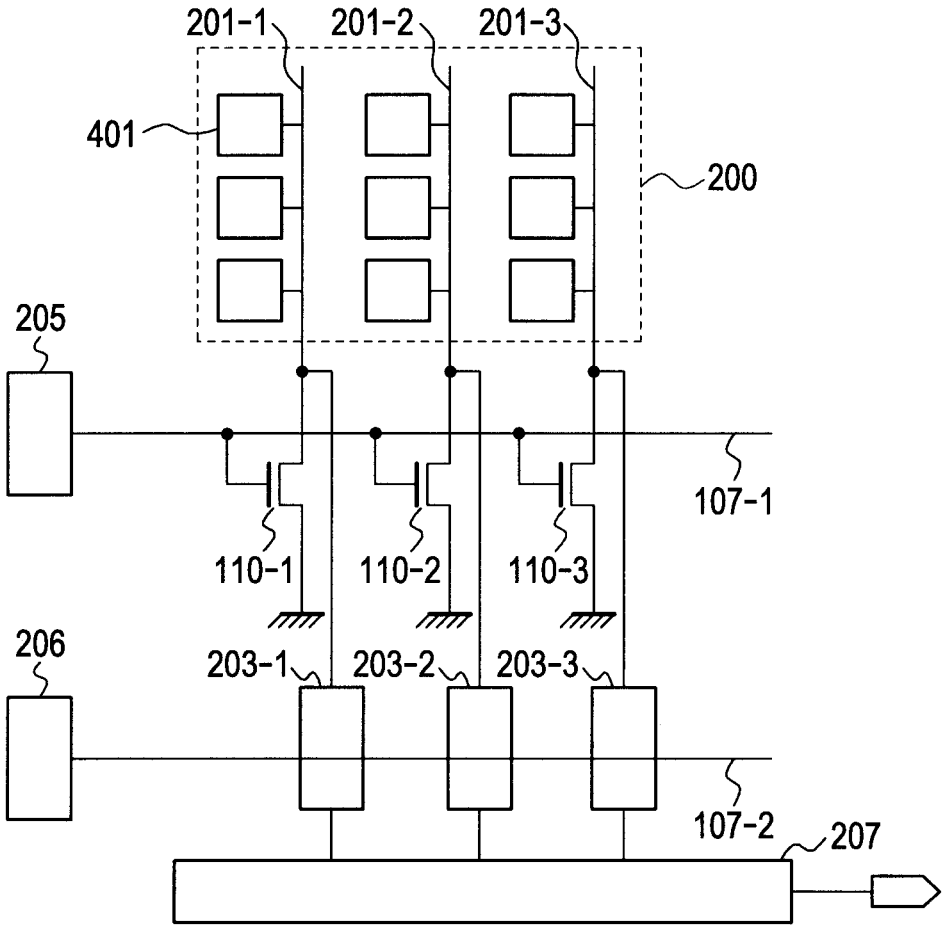
FIG. 4 is a diagram illustrating an exemplary arrangement of a solid imaging apparatus according to the second embodiment of the invention.

FIG. 4 is a diagram illustrating an exemplary arrangement of a solid imaging apparatus according to the second embodiment of the invention. The solid imaging apparatus of the embodiment uses the constant current source of the first embodiment. A pixel array (for example, 3 pixels×3 pixels) 200 is illustrated. The pixel array 200 has a plurality of pixels 401 arranged in a two-dimensional matrix. The pixel 401 has a photoelectric conversion element for generating a pixel signal by photoelectric conversion and a source-follower amplifier for amplifying the generated pixel signal. A plurality of vertical output lines 201-1 to 201-3 are connected in common to the pixels 401 of each column in the 2-dimensional matrix. The pixels 401 of the selected row output the pixel signals to the vertical output lines 201-1 to 201-3 on a row unit basis. NMOS transistors 110-1 to 110-3 of the constant current sources are connected to the vertical output lines 201-1 to 201-3, respectively. The NMOS transistors 110-1 to 110-3 correspond to the NMOS transistors 110 in FIG. 1 and are connected between the vertical output lines 201-1 to 201-3 and the ground electric potential node, respectively. Constant current sources 205 and 206 are portions other than the NMOS transistor 110 and the voltage supplying line 107 in the constant current source in FIG. 1 and have the same arrangement. Voltage supplying lines 107-1 and 107-2 correspond to the voltage supplying line 107 in FIG. 1. Gates of the NMOS transistors 110-1 to 110-3 are connected to the first constant current source 205 through the voltage supplying line 107-1. As illustrated in FIG. 1, the NMOS transistors 110-1 to 110-3 construct the current mirror circuit 145 for supplying the current Iout according to the first current Ic of the first current source circuit 120 to the plurality of vertical output lines 201-1 to 201-3.

Column read-out circuits (signal processing circuits) 203-1 to 203-3 are connected between the vertical output lines 201-1 to 201-3 and a horizontal read-out circuit 207, respectively. The second constant current source 206 is connected to the column read-out circuits 203-1 to 203-3 through the voltage supplying line 107-2. The horizontal read-out circuit 207 transfers from every row an output signal of each pixel 401 processed by a column read-out circuit 203 and outputs the signals to the outside of the solid imaging apparatus.

In the arrangement of the embodiment, the signals output from the pixels 401 are sampled and held by the column read-out circuits 203-1 to 203-3 and output to the outside of the solid imaging apparatus through the horizontal read-out circuit 207. Since the currents of the NMOS transistors 110-1 to 110-3 of the constant current source cause an influence on the output signal level of each pixel 401, the use of the constant current source of the invention allows for the reduced time-dependent fluctuation of the output signal of each pixel 401 that is caused by the noises generated in the constant current source. Thus, the horizontal stripe noises generated in the image can be reduced. In the constant current source 206, a bias voltage is applied to the column read-out circuits 203-1 to 203-3 of each column, operation points of the column read-out circuits 203-1 to 203-3 of each column are held, and the read-out operation can be stabilized.

In the case of the column read-out circuits 203-1 to 203-3 illustrated in the embodiment with analog signal processing circuits, the horizontal read-out circuit 207 becomes a transfer circuit of the analog signals. If the column read-out circuits 203-1 to 203-3 have analog/digital converters (A/D converters), the horizontal read-out circuit 207 becomes a transfer circuit of the digital signals. Although the bias voltage is supplied by using the constant current source 206 in the embodiment, the embodiment is not limited to such an arrangement. An arrangement may be used in which the constant current source supplies the current itself to the column read-out circuits 203-1 to 203-3. Another arrangement may be used in which a desired voltage is specified by using the current generated by the constant current source and such a voltage is supplied as a bias voltage adapted to decide the operation points of the column read-out circuits 203-1 to 203-3. The arrangement of a solid imaging apparatus by incorporating the constant current source therein allows for the reduced noises of the column read-out circuits 203-1 to 203-3 and the reduced horizontal stripe noises generated in the image.

Although the embodiment has been described above with respect to the example in which the two constant current sources 205 and 206 are provided, one common constant current source can also bias the voltage supplying lines 107-1 and 107-2 in common. In the case where the constant current source is used in the solid imaging apparatus, a change in moving image mode/still image mode, a change in amplifier gain, or the like can be mentioned as an example of the operating mode change which needs the tuning sequence of the current value of the constant current source. By using a method whereby the control logic circuit 150 of the constant current source continuously holds the setting during the image pickup operation of at least one frame, the level of the output obtained in one frame can be held constant. The current adjusting sequence is carried out in accordance with the necessity at the time of the operation of the solid imaging apparatus as mentioned above, so that the output of the current source can be stabilized irrespective of the change in operating mode or the ambient environment and the generation of the lateral stripe noises can be reduced.

Figure 5A:
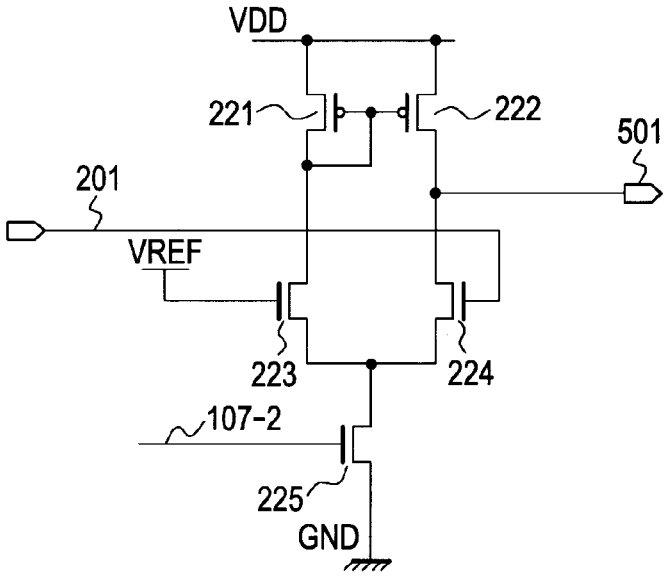
FIGS. 5A and 5B are diagrams illustrating exemplary arrangements of column read-out circuits in FIG. 4.

Next, exemplary arrangements of the column read-out circuits 203-1 to 203-3 in FIG. 4 will be described with reference to FIGS. 5A and 5B. FIG. 5A is a diagram illustrating the exemplary arrangement of the column read-out circuits 203-1 to 203-3 having a differential amplifier of an analog processing circuit. The differential amplifier amplifies a difference voltage between a signal voltage of a vertical output line 201 and a predetermined voltage VREF and outputs the obtained voltage from an output terminal 501. NMOS transistors 223 and 224 function as input MOS transistors. PMOS transistors 221 and 222 function as active loads. The voltage supplying line 107-2 is connected to a gate of a current source transistor 225. The differential amplifier operates by the current which is determined by the current source 225, and a bias voltage necessary for the operation is supplied from the outside through the voltage supplying line 107-2. By setting the bias voltage to a low-noise voltage by the constant current source 206, the fluctuation of the current of the current source 225 can be reduced, so that an amplification factor of the differential amplifier can be stabilized.

Figure 5B:
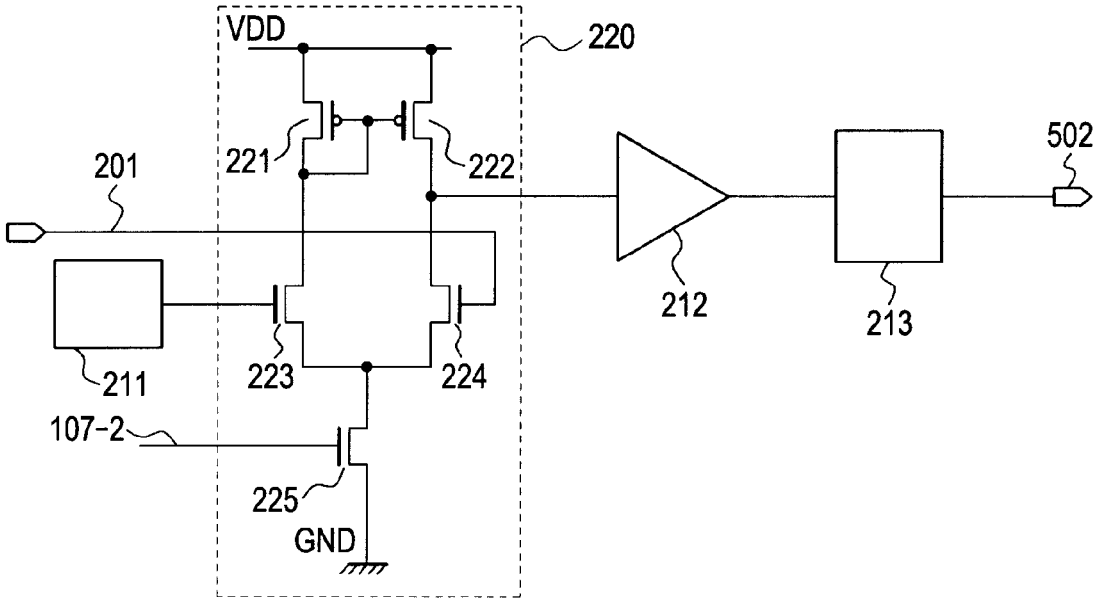

FIG. 5B is a diagram illustrating the exemplary arrangement of the column read-out circuits 203-1 to 203-3 using an A/D converter of a ramp voltage comparison type. The ramp voltage comparison type A/D converter has a reference voltage source 211, a comparator 220, a buffer circuit 212, and the counter 213 and converts the analog signal into the digital signal. The reference voltage source 211 generates a voltage signal of a ramp waveform of a predetermined period. The comparator 220 has substantially the same arrangement as that of the differential amplifier illustrated in FIG. 5A. The voltage signal output from the vertical output line 201 is input to the comparator 220 and compared with the voltage of the reference voltage source 211. A comparison result is output to a counter 213 through the buffer circuit 212 as an output of the comparator 220. In the counter 213, a time required until the output of the comparator 220 is inverted is counted every period of the ramp signal of the reference voltage source 211 by the number of pulses of a reference clock (not shown). A count value is output as a digital conversion result from an output terminal 502. The comparator 220 operates by the current which is determined by the current source transistor 225. A bias voltage which is necessary for this purpose is supplied from the outside of the circuit through the voltage supplying line 107-2. A current amount of the current source transistor 225 is compared by the comparator 220 and also causes an influence on a time required until the output of the comparator 220 is obtained. In the A/D converter in the related art, since the time required until the output of the comparator 220 is obtained varies due to a fluctuation of the current source transistor 225, an A/D conversion result also varies. By setting the bias voltage to the low-noise voltage by the constant current source 206, the fluctuation of the current of the current source transistor 225 decreases and the stable A/D conversion result can be obtained. Although the A/D converter of the ramp voltage comparison type has been mentioned as an example of the A/D converter in the embodiment, the embodiment of the invention is not limited to it.

As mentioned above, the first current source circuit 120 can generate the current Ic having lower precision but smaller noises. The second current source circuit 130 can generate the current Iref having larger noises but higher precision. By combining the first current source circuit 120 and the second current source circuit 130, the constant current sources of the first and second embodiments can generate the current having smaller noises and higher precision. The use of the constant current sources in the solid imaging apparatus allows a good image having a smaller amount of the horizontal stripe noises to be obtained.

In the foregoing embodiments, the examples of embodying the invention have merely been shown and the technical scope of the invention should not be limitedly interpreted by them. That is, the invention can be embodied in various forms without departing from its technical idea or its main features.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-179744, filed Aug. 10, 2010, which is hereby incorporated by reference herein in its entirety.

What is claimed is:

1. A constant current source, comprising:

a first current source circuit that outputs a first current;

a second current source circuit that outputs a second current according to a reference voltage, said second current source circuit comprising (i) a first MOS transistor that flows the second current, (ii) a reference voltage generating unit that outputs a constant voltage, and (iii) an operational amplifier having a non-inverting input terminal connected to an output terminal of the reference voltage generating unit, an inverting input terminal connected to a source of the first MOS transistor, and an output terminal connected to a gate of the first MOS transistor;

a current comparison circuit that compares magnitudes of the first current and the second current; and a current adjustment unit that adjusts a current value of the first current output in accordance with a result of the comparison of the current comparison circuit.

2. The constant current source according to claim 1, wherein the first current source circuit has a variable resistor and a diode-connected MOS transistor, the variable resistor and the MOS transistor are connected in series, and the current adjustment unit adjusts the resistance value of the variable resistor.

3. The constant current source according to claim 1, wherein the current adjustment unit holds the adjustment of the current value of the first current when the comparison result of the current comparison circuit satisfies a condition.

4. The constant current source according to claim 1, wherein the first current source circuit has a variable resistance unit having a plurality of resistors having different resistance values, and the current adjustment unit controls so as to connect the plurality of resistors selectively.

5. The constant current source according to claim 4, wherein the current adjustment unit initializes a value of the variable resistance unit to a maximum resistance value of the variable resistance unit, decreases the value of the variable resistance unit until the first current becomes larger than the second current, and maintains the value of the variable resistance unit when the first current becomes larger than the second current.

6. The constant current source according to claim 1, wherein the current comparison circuit comprises:

a first current mirror circuit flowing a third current according to the first current;

a second current mirror circuit flowing a fourth current according to the second current; and a comparator comparing a voltage according to the third current with a voltage according to the fourth current.

7. A solid imaging apparatus, comprising:

a plurality of pixels arranged in a two-dimensional matrix, each pixel having a photoelectric conversion element and an amplifier;

a plurality of output lines connected in common to the pixels of each column in the two-dimensional matrix;

a first constant current source for outputting a first current, said first constant current source comprising (i) a first current source circuit that outputs first current, (ii) a second current source circuit that outputs a second current according to a reference voltage, (iii) a current comparison circuit that compares magnitudes of the first current and the second current, and (iv) a current adjustment unit that adjusts a current value of the first current output from the first current source circuit in accordance with a result of the comparison of the current comparison circuit; and a current mirror circuit for allowing a current based on the first current to flow in the plurality of output lines, wherein the second current source circuit comprises (i) a first MOS transistor that flows the second current, (ii) a reference voltage generating unit that outputs a constant voltage, and (iii) an operational amplifier having a non-inverting input terminal connected to an output terminal of the reference voltage generating unit, an inverting input terminal connected to a source of the first MOS transistor, and an output terminal connected to a gate of the first MOS transistor.

8. The solid imaging apparatus according to claim 7, wherein the first current source circuit comprises a variable resistor and a diode-connected MOS transistor, the variable resistor and the MOS transistor being connected in series, and the current adjustment unit adjusts the resistance value of the variable resistor.

9. The solid imaging apparatus according to claim 7, further comprising:

a plurality of signal processing circuits connected to the plurality of output lines, respectively; and a second constant current source having a same arrangement as that of the first constant current source, wherein the plurality of signal processing circuits are biased by the second constant current source.

10. The solid imaging apparatus according to claim 9, wherein the first constant current source and the second constant current source are one common circuit.

11. The solid imaging apparatus according to claim 9, wherein the plurality of signal processing circuits have respective analog/digital converters.

12. The constant current source according to claim 7, wherein the first current source circuit has a variable resistance unit having a plurality of resistors having different resistance values, and the current adjustment unit controls so as to connect the plurality of resistors selectively.

13. The constant current source according to claim 12, wherein the current adjustment unit initializes a value of the variable resistance unit to a maximum resistance value of the variable resistance unit, decreases the value of the variable resistance unit until when the first current becomes larger than the second current, and maintains the value of the variable resistance unit when the first current becomes larger than the second current.

14. The constant current source according to claim 7, wherein the current comparison circuit comprises:

a first current mirror circuit flowing a third current according to the first current;

a second current mirror circuit flowing a fourth current according to the second current; and a comparator comparing a voltage according to the third current with a voltage according to the fourth current.

* * * * *